United States Patent [19]

Chevrel et al.

[11] Patent Number: 4,515,491

[45] Date of Patent: May 7, 1985

[54] DEVICE FOR OPENING AND CLOSING AN EXIT SLIT FOR A DATA CARRIER AND A PRINTER UTILIZING SUCH DEVICE

[75] Inventors: Roger Chevrel; Michel Attard; Michel Leviandier, all of Paris, France

[73] Assignee: Compagnie d'Informatique Militaire Spatiale & Aeronautique-CIMSA-25, Paris, France

[21] Appl. No.: 511,239

[22] Filed: Jul. 6, 1983

[30] Foreign Application Priority Data

Jul. 6, 1982 [FR] France ..... 82 11842

[51] Int. Cl.[3] ..... B41J 29/12

[52] U.S. Cl. ..... 400/693; 400/690.4; 400/713

[58] Field of Search ..... 400/693, 713, 685, 690, 400/690.1, 690.2, 690.3, 690.4; 312/208, 319

[56] References Cited

U.S. PATENT DOCUMENTS

| | | | |
|---|---|---|---|
| 197,833 | 12/1877 | Deming | 400/690.1 |
| 1,234,086 | 7/1917 | Powers | 400/690 |
| 2,456,429 | 12/1948 | Parsons | 312/319 X |
| 2,800,256 | 7/1957 | DiNuzzo | 222/161 X |
| 3,050,171 | 8/1962 | Baumgartner | 400/713 X |
| 4,164,376 | 8/1979 | Yarp | 400/605 X |

FOREIGN PATENT DOCUMENTS

| | | |
|---|---|---|
| 401597 | 9/1924 | Fed. Rep. of Germany . |
| 2387124 | 11/1978 | France . |
| 207528 | 11/1939 | Switzerland . |

*Primary Examiner*—Edgar S. Burr
*Assistant Examiner*—Charles A. Pearson
*Attorney, Agent, or Firm*—Oblon, Fisher, Spivak, McClelland & Maier

[57] ABSTRACT

A device for opening and closing a data carrier exit slit. The device includes a mobile door disposed at the level of the slit so as to cover it and a mechanism for raising and lowering the door, so that the door occupies a raised position in which the slit is open, thus allowing the carrier to leave and a lowered position in which the slit is sealingly closed, thus preventing the carrier from leaving.

10 Claims, 2 Drawing Figures

DEVICE FOR OPENING AND CLOSING AN EXIT SLIT FOR A DATA CARRIER AND A PRINTER UTILIZING SUCH DEVICE

BACKGROUND OF THE INVENTION

1. Field of the Invention

The present invention relates to a device for opening and closing an exit slit for a data carrier used more particularly for a printer or a typewriter wherein by the phrase "data carrier" is meant either a paper sheet, or a magnetic tape, or any other flat and thin element on which data is stored.

2. Description of the Prior Art

Generally, a printer is in the form of a parallel-epipedic frame comprising, at its upper face, a constantly open slit, that is to say opening into the free air, and through which leaves the paper after data printing.

However, when a printer is intended to be installed in a location where the reigning external conditions are particularly difficult, formed for example by the presence of dust, dirt, sand or humidity, it is indispensable to sealingly protect the paper exit slit so as to avoid any intrusion of foreign particles into the slit with the risk of damaging the mechanism of the printer.

Now, a printer whose paper exit slit is constantly open, and thus unprotected, does not satisfy the requirement called for by the above-mentioned difficult external conditions.

The aim of the present invention is to comply with this requirement by proposing a device for opening and closing the exit slit, for example of a printer, which is entirely satisfactory, of a simple structure and ensures perfectly sealed protection of the slit while allowing the paper to exit continuously.

SUMMARY OF THE INVENTION

The invention provides a device for opening and closing an exit slit for a data carrier, the slit being formed in a part ensuring the passage of the carrier through the slit, this device comprising:

a part forming a mobile door disposed at the level of the slit so as to cover it; and means for lifting and lowering the door, so that the door occupies a raised position in which the slit is open, thus allowing the carrier to leave and a lowered position in which the slit is sealingly closed, thus preventing the carrier from leaving.

According to another feature of the invention, the means for raising and lowering the door comprises two parts forming mobile pistons aligned along the longitudinal axis of the slit, disposed on each side thereof and fixedly mounted at one of their ends to the door, and the movement of each piston is controlled by an electromagnet whose core is fixed to the other end of the piston, so that by energizing and de-energizing the coils of each of the electromagnetis, each assembly formed by the core and the associated piston moves vertically so as to raise and lower the door.

The invention also relates to a printer comprising a device for opening and closing its paper exit slit in accordance with the invention.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
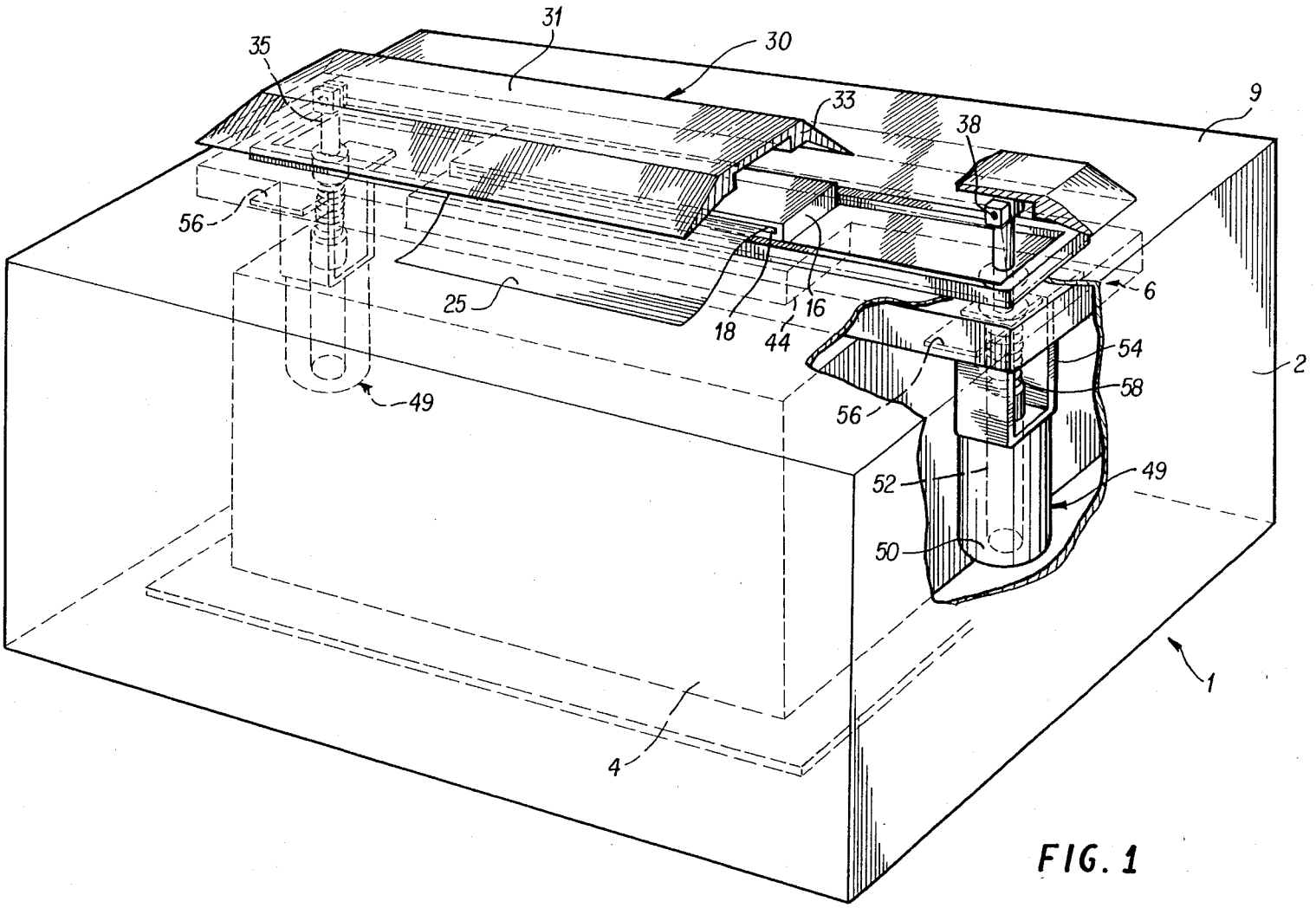
FIG. 1 shows a general perspective view, with parts cut away, of a printer equipped with a device for opening and closing its paper exit slit in accordance with the invention, the door being in the raised position.
Figure 2:
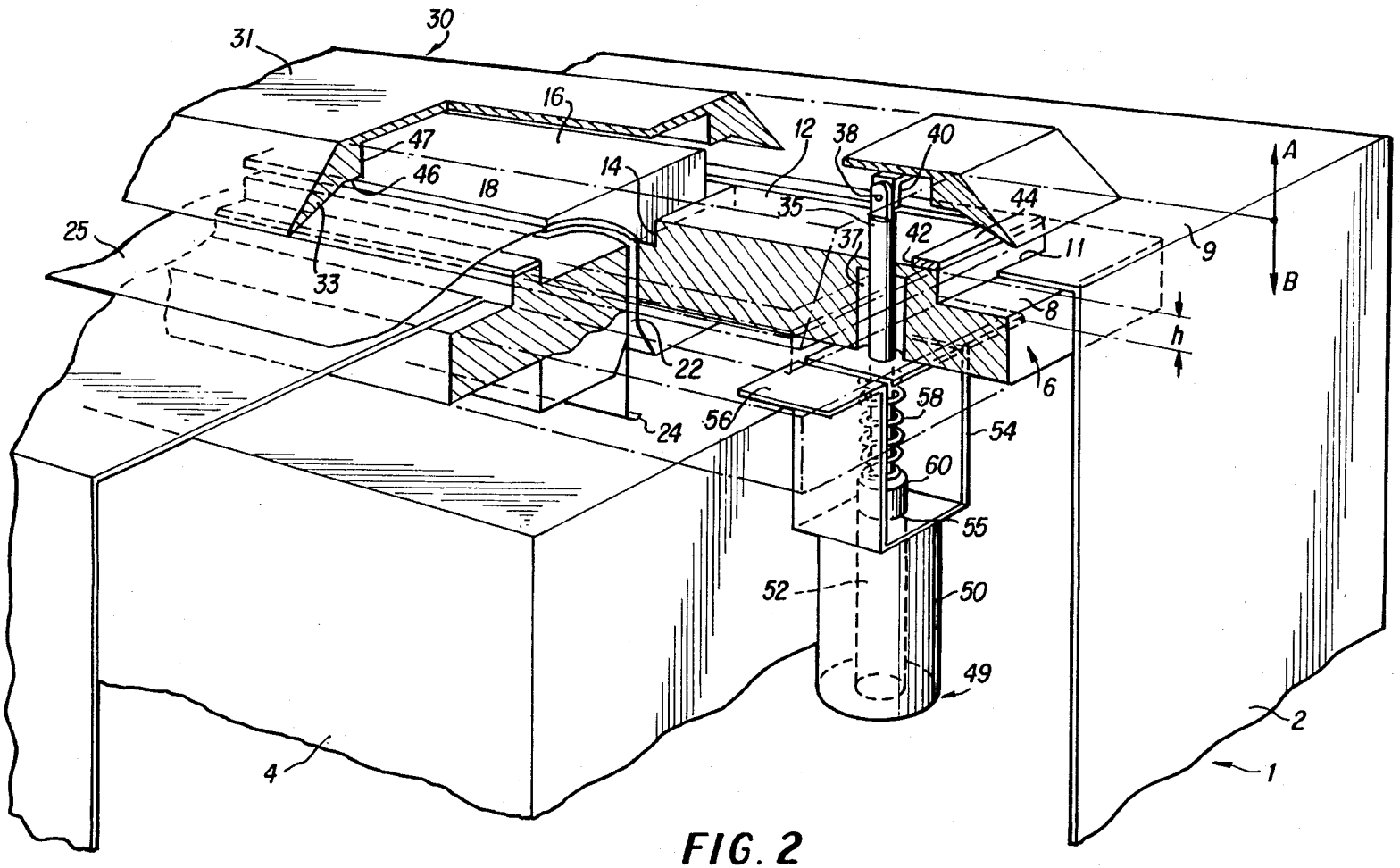
FIG. 2 shows a perspective view, with parts cut away, of the device for opening and closing the paper exit slit in accordance with the invention, the door being in the raised position.

In one embodiment, and referring to FIGS. 1 and 2, a printer 1 comprises a frame or case 2, parallelepipedic in shape, inside which is housed among other things a block 4 for printing data on paper, known per se.

The printer 1 also comprises a part forming base 6, substantially parallelèpipedic in shape, housed inside frame 2 and whose upper face comprises a set-back 8 (FIG. 2) to which is fixed the upper face 9 of the frame of the printer. This upper face 9 of the frame is provided with a central opening, rectangular in shape, shown schematically by reference number 11 in FIG. 2, and from which projects base 6 over a given height h.

As is apparent from FIG. 2, base 6 comprises, substantially at the center of its upper face 12, an indentation 14, rectangular in shape, in which is fixedly mounted a part 16, parallelepipedic in shape, inside which is formed a slit 18 forming a paper exit.

More precisely, slit 18 has, in longitudinal section, a rectangular shape of a length slightly greater than the width of the paper, opening out into one of the lateral faces of part 16 and, in cross section, a rounded shape 20 (FIG. 2) for guiding the paper during its passage through the slit. This rounded shape of slit 18 opens into a channel 22 (FIG. 2) formed in base 6 opposite an opening 24 called exit for the paper loaded inside the printing block 4.

There is shown at 25 the paper sheet leaving through slit 18, and as can be seen in FIG. 2, the paper 25 passes vertically into channel 22, then is bent, while still being guided, at the level of the rounded shape 20 of slit 18 and exits from slit 18 on one of the sides of part 16 thus ensuring passage of the paper through said slit.

The printer 1 further comprises a device for opening and closing the slit 18 through which exits the paper 25, in accordance with the invention, and which will now be described.

According to a preferred embodiment, this device, shown generally at 30, comprises a mobile door or trap having the general form of a parallelepipedic protecting cover 31 but with tapering flanges, for example made from aluminium, disposed above the upper face of frame 2 and provided with tapering flanges 33 surrounding slit 18 so as to protect this latter. Cover 31 is able to occupy a raised position in which slit 18 is open, thus allowing paper 25 to leave and a lowered position in which slit 18 is closed, thus preventing the paper from leaving.

More precisely, device 30 comprises means for raising and lowering cover 31, formed for example by two mobile pistons or rods 35 aligned along the longitudinal axis of the slit 18 and disposed on each side thereof. Each piston 35, only one of which can be seen in FIG. 2, passes through base 6 through an opening 37 (FIG. 2). One of the ends of each piston 35 is interconnected, by means of a flexible articulation formed, for example by a shaft 38 perpendicular to that of the piston, with a plate 40 (FIG. 2) fixedly mounted on the inner part of the upper face of cover 31, so that the pistons-cover assembly forms a unitary assembly.

Each piston 35 is intended to move vertically by means of an appropriate control system, to be described below, so as to raise and lower cover 31. Arrow A in FIG. 2 shows the upward movement of cover 31, under the action of pistons 35, corresponding to the raised position of said cover in which slit 18 is open, and arrow B shows the downward movement of cover 31 corresponding to the lowered position of said cover in which the slit 18 is closed.

Of course, the protecting cover 31 could also undergo movement other than vertical, under the action of an appropriate mechanical system, without departing from the scope of the invention.

As can be clearly seen in FIG. 2, base 6 comprises, at the periphery of its upper face 12, a rectangular shoulder 42 on which is mounted in abutment a seal 44, made for example from rubber, having the form of a frame surrounding slit 18, so that once in the lowered position, defined by arrow B in FIG. 2, the cover 31 comes to bear, at the level of the right-hand part 46 of its flanges 33, on seal 44 thus closing slit 18 with a perfect seal.

Each flange 33 also has, in cross section, a vertical right-hand part 47 (FIG. 2), so that the part 47 of the flange disposed opposite slit 18 closes this latter when cover 31 is in the lowered position.

In FIGS. 1 and 2, each piston 35 is controlled by an electromagnet 49 of which the coils are shown at 50 and at 52 the core disposed in the extension of the associated piston 35. The coils 50 of each electromagnet are supported by a part 54 having a U shape in cross section whose horizontal arm comprises an opening 55 (FIG. 2) through which is intended to slide vertically the core 52 fixed to one end of the associated piston 35. The two vertical arms of the U shaped part 54 are integral with a plate 56 fixed to the lower face of base 6 and having therethrough an aperture for passage of piston 35.

In addition, each electromagnet 49 is associated with a spring 58 mounted about the piston 35, and one of the ends of spring 58 is fixed to the plate 56, whereas its other end is fixedly mounted to a circular shoulder 60 of piston 35.

The operation of the device for opening and closing the paper exit slit is as follows.

After having switched on the printer, with cover 31 in the lowered position, each electromagnet 49 is controlled for example by the advance of paper 25 leaving the printing block 4, causing coils 50 to be energized. Then, each assembly formed by the core 52 of each electromagnet and the associated piston 35 moves upwardly while compressing spring 58. Thus, each piston 35 integral with cover 31 moves said cover upwards (arrow A in FIG. 2). Thus, during movement of the cover 31 the side 47 of flange 33 situated opposite slit 18 is freed from this latter, which results in opening the slit through which the paper 25 may leave by sliding under the flange 33 of the cover thus raised.

When the printer is switched off, with cover 31 in the raised position, the advance of the paper leaving the printing block 4 is stopped, which causes de-energization of the coils of each electromagnet 49. Then, each assembly formed by the core 52 of each electromagnet and the associated piston 35 moves downwards while relaxing spring 58. Thus, each piston 35 integral with cover 31 moves said cover downwards (arrow B in FIG. 2) so that the side 46 of each flange 33 comes to bear on the seal 44, whereas the side 47 of flange 33 disposed at the level of slit 18 comes and closes off this latter which is thus sealed. Consequently, the protecting cover 31 sealingly closes slit 18, thus preventing paper 25 from leaving.

It will be noted that the above description has been made with reference to a printer comprising a device for opening and closing the exit slit for the paper on which data are stored. Of course, the opening and closing device applies also to any other machine, such for example as a typewriter, comprising an exit slit for any kind of carrier, i.e. a carrier with or without data, without departing from the scope of the invention.

We claim:

1. A device for opening and closing an exit slit for a data carrier, said slit being formed in a part providing passage of said carrier through said slit, comprising:

a mobile door disposed at a level of said slit so as to cover the latter;

means for raising and lowering said door, including first and second mobile pistons aligned along a longitudinal axis of said slit, said pistons being disposed on each side of said slit and fixedly mounted at one end thereof to said door, each of said pistons having a shoulder portion;

electromagnetic means for controlling operation of each of said first and second pistons wherein said electromagnetic means further comprises a coil and a core which are fixed to an end opposite said one end of said pistons; and means for energization and de-energization of said coil of said electromagnetic means such that each assembly formed by said core and an associated piston moves vertically so as to raise and lower said door wherein said electromagnetic means further comprises a spring mounted about each said piston, one end of each spring being fixedly disposed on a part forming a base through which passes each said piston, and a second end of each spring being disposed on said shoulder portion of each piston so that, by de-energization of the coil of each said electromagnetic means, each assembly formed by said core and the associated piston moves downwardly while causing relaxation of each said spring so that said door obtains a lowered position in which said exit slit is closed;

further comprising first and second support parts each having a U shape in cross-section and each having a horizontal arm which includes a central opening through which slides said assembly formed by said core and the associated piston and having two vertical arms which are interlocked with said base, the coil of each of said electromagnet means being fixedly mounted to the horizontal arm of each U-shaped support part.

2. A device as claimed in claim 1, further comprising means for controlling each said electromagnet means by the advance of said carrier intended to leave through said slit once opened.

3. A device as claimed in claim 1, wherein said door further comprises a cover having tapering flanges surrounding said slit so as to protect the latter, said carrier leaving at a level of one of said flanges after passing through said slit when said door is in a raised position.

4. A device as claimed in claim 1, further comprising seal means on which said door comes to rest when said door is in a lowered position for permitting said slit to be sealingly closed.

5. A device as claimed in claim 4, wherein said seal means further comprises a frame surrounding said slit such that said door comes to bear on said seal means when said door is in a lowered position.

6. A device as claimed in claim 1, wherein said means for raising said door further comprises means for linearly moving said door in a vertical direction.

7. A printer which includes a parallelepipedic frame having an upper face provided with an opening in which is housed a device for opening and closing an exit slit for a data carrier formed by a sheet of paper, comprising:

a mobile door disposed at a level of said slit so as to cover the latter;

means for raising and lowering said door, including first and second mobile pistons aligned along a longitudinal axis of said slit, said pistons being disposed on each side of said slit and fixedly mounted at one end thereof to said door;

electromagnetic means for controlling operation of each of said first and second pistons wherein said electromagnetic means further comprises a coil and a core which are fixed to an end opposite said one end of said pistons; and means for energization and de-energization of said coil of said electromagnetic means such that each assembly formed by said core and an associated piston moves vertically so as to raise and lower said door;

wherein each said piston has a shoulder portion; said electromagnet means further comprises a spring mounted about each said piston, one end of each spring being fixedly disposed on a part forming a base through which passes each said piston, and a second end of each spring being disposed on a shoulder portion of each piston, so that by de-energization of the coil of each said electromagnet means, each assembly formed by said core and the associated piston moves downwardly while causing relaxation of each said spring so that said door obtains a lowered position in which said exit slit is closed, and wherein said base through which pass said pistons is generally parallelepipedic in shape and includes an indentation in which is fixedly mounted said part in which is formed said slit.

8. A printer as claimed in claim 7, wherein said slit is formed in a part providing passage of said carrier through said slit.

9. A printer as claimed in claim 8, wherein said base further comprises a channel for the passage of the paper opening on to said slit and having in section of rounded shape for guiding said carrier during passage thereof through said slit.

10. A printer as claimed in claim 8, wherein said means for raising said door further comprises means for linearly moving said door in a vertical direction.

* * * * *